US010974880B2

(12) United States Patent
Yan

(10) Patent No.: US 10,974,880 B2
(45) Date of Patent: Apr. 13, 2021

(54) BEVERAGE CONTAINER AND METHOD FOR PREVENTING SPILLAGE OF BEVERAGES

(71) Applicant: Taihang Yan, Hebei (CN)

(72) Inventor: Taihang Yan, Hebei (CN)

( * ) Notice: Subject to any disclaimer, the term of this patent is extended or adjusted under 35 U.S.C. 154(b) by 63 days.

(21) Appl. No.: 16/364,225

(22) Filed: Mar. 26, 2019

(65) Prior Publication Data

US 2020/0207528 A1 Jul. 2, 2020

(51) Int. Cl.
*B65D 51/24* (2006.01)

(52) U.S. Cl.
CPC .... *B65D 51/24* (2013.01); *B65D 2543/00046* (2013.01)

(58) Field of Classification Search
CPC ..... B65D 51/24; B65D 2543/00046; B65D 85/73; B65D 81/245; B65D 17/34; B65D 85/72; B65D 90/52; B65D 2590/24; B65D 90/24; B65D 51/007; B65D 71/00; B65D 5/00; B65D 5/32; B65D 2543/00037; B65D 88/34; B65D 90/22; A47G 2200/02; A47G 19/22–23
See application file for complete search history.

(56) References Cited

U.S. PATENT DOCUMENTS 1,990,918 A * 2/1935 Ramsden ..... A47G 19/12 222/491
2,556,195 A * 6/1951 Kors ..... B44D 3/12 220/578
3,256,977 A * 6/1966 Pettersen ..... B65D 81/245 206/216
3,360,161 A * 12/1967 Smith ..... A47G 19/2272 220/719
4,961,510 A * 10/1990 Dvoracek ..... B65D 25/48 220/258.2
5,143,248 A * 9/1992 Sawatsky ..... B65D 47/265 220/253
5,749,491 A * 5/1998 Wylder ..... A47G 19/2211 215/387
5,979,689 A * 11/1999 Lansky ..... A47G 19/2272 220/255
7,017,768 B2 * 3/2006 Iskierka ..... A47G 19/2211 116/207
8,033,420 B2 * 10/2011 Roseblade ..... B65D 51/24 220/731
8,360,258 B2 * 1/2013 Gilbert ..... B65D 47/32 220/254.9
8,444,004 B1 * 5/2013 Draganic ..... A47G 19/2205 220/719
9,840,364 B2 * 12/2017 Savenok ..... B65D 47/06
2001/0010864 A1 * 8/2001 Ashcraft ..... B32B 27/06 428/463

(Continued)

*Primary Examiner* — Kareen K Thomas

(57) ABSTRACT

Disclosed is a beverage container including a container body (1) and a floating object (2) for reducing the sloshing amplitude of the beverage, the floating object (2) is set in the container body (1) and floats on the surface of the beverage in the container body (1), the floating object (2) is larger than an opening (3) of a top cover (4) of the container body (1), the floating object (2) is provided with at least one through hole (21) for preventing the floating object (2) from blocking the opening (3) of the top cover (4) of the container body (1).

5 Claims, 3 Drawing Sheets

(56) References Cited

U.S. PATENT DOCUMENTS

| | | | | |
|---|---|---|---|---|
| 2004/0232154 | A1* | 11/2004 | Smith | A47G 19/2211 220/713 |
| 2008/0156817 | A1* | 7/2008 | Roseblade | A47G 19/2211 220/713 |

* cited by examiner

BEVERAGE CONTAINER AND METHOD FOR PREVENTING SPILLAGE OF BEVERAGES

CROSS REFERENCE TO RELATED APPLICATIONS

The present application claims the benefit of Chinese Patent Applications No. 201811613774.6 filed on Dec. 27, 2018, the contents of which are hereby incorporated by reference.

FIELD OF THE INVENTION

The present invention relates to the field of liquid containers, and in particular, to a beverage container and a method for preventing spillage of beverages.

BACKGROUND OF THE INVENTION

In recent years, with the improvement of the quality of people's life and the acceleration of the pace of life, the dietary structure of consumers and their eating habits have changed. People start to pursue simple and fast diet, which has also become a new consuming trend. Due to the awareness of living a healthy life, the market starts to widely sell milk, juice drinks, carbonated beverages and tea beverages. And young people are the main consumers. The containers of these beverages are different. Among them, cans and special paper boxes are most widely used. Cans and the boxes are respectively provided with a dispense area for sealing the beverage container and a pull tab connected to the dispense area. The beverage container is opened through pulling the pull tab to separate the dispense area from the container.

Usually, while pulling the pull tab or walking with the beverage container after it is opened, the container shakes. When the beverage in the container oscillates with the shaking amplitude of the container, a resonance effect occurs, and the fluctuation range and impact force of the beverage in the container are further increased. As a result, the beverage in the container is easily spilled, which causes inconvenience to drinking.

SUMMARY OF THE INVENTION

The present invention provides a beverage container and a method for preventing spillage of beverages to solve the problem of beverage spillage caused by resonance of the beverage container and the beverage.

In order to achieve the above objective, the embodiments of the present invention provide the following technical solutions.

A beverage container comprises a container body and a floating object for reducing the sloshing amplitude of the beverage. The floating object is set in the container body and floats on the surface of the beverage in the container body. The floating object is larger than an opening of a top cover of the container body. The floating object is provided with at least one through hole for preventing the floating object from blocking the opening of the top cover of the container body. The floating object is made of food grade material, and the density of which is less than or equal to the density of the liquid in the container body.

Preferably, the floating object is a round piece or of other geometric shapes.

Preferably, the floating object is connected to an inner wall of a top cover of the container body by a thread.

Preferably, the thread is free to move with the floating object and the beverage.

Preferably, the thread is a sanitary sterilized cotton thread.

Optionally, the container body is a metal can.

Optionally, the container body is a carton beverage box.

The invention also discloses a method for preventing spillage of beverages, wherein the method for preventing spillage of beverages adopts the beverage container described above. The method comprises: pouring a beverage into the beverage container, placing the floating object in the beverage container for it to float on the beverage; and sealing the beverage container.

While pulling the pull tab or walking with the beverage container after it is opened, the beverage container shakes to cause the beverage to slosh and the beverage sloshes to cause the floating object to sway simultaneously. The inertial force generated by the floating object swaying thus collides with the impact generated by the beverage shaking so that a portion of the impact caused from the beverage is counteracted. Since the floating object always floats on the surface of the beverage and is larger than the opening of the container body, the floating object forms a barrier to prevent the beverage from spilling. In addition, the floating object is able to change the surface tension of the beverage to prevent the spillage of the beverage.

The present invention has the following advantages:

The embodiments of the present invention provide a beverage container and a method for preventing spillage of beverages. Since the floating object is larger than the opening of the container body and is pre-setting in the container body fulfilled with beverages, a portion of the impact caused from the beverage is counteracted when the inertial force generated by the floating object swaying collides with the impact generated by the beverage shaking. Since the floating object always floats on the surface of the beverage so that it forms a barrier to prevent the beverage from spilling.

BRIEF DESCRIPTION OF DRAWINGS

In order to clearly illustrate the embodiments of the present invention or the technical solutions in the prior art, the drawings used in the embodiments or the description of the prior art will be briefly described below. It is obvious that the drawings in the following description are merely exemplary, and those skilled in the art are able to obtain other drawings according to the drawings provided without any creative work.

It should be understood that the structures, the proportions, and the sizes illustrated in the drawings are only used for supporting the contents disclosed in the specification so as to give the skilled in the art a better understanding. These conditions are not intended to limit the implementation of the present invention therefore are not technically meaningful. Any modifications to the structure, changes to the proportion or adjustments to the size, on the premises of not affecting the effects and the achievable objects of the present invention, are able to fall within the scope of the technical content disclosed in the present invention.

LIST OF REFERENCE NUMERALS

Figure 1:
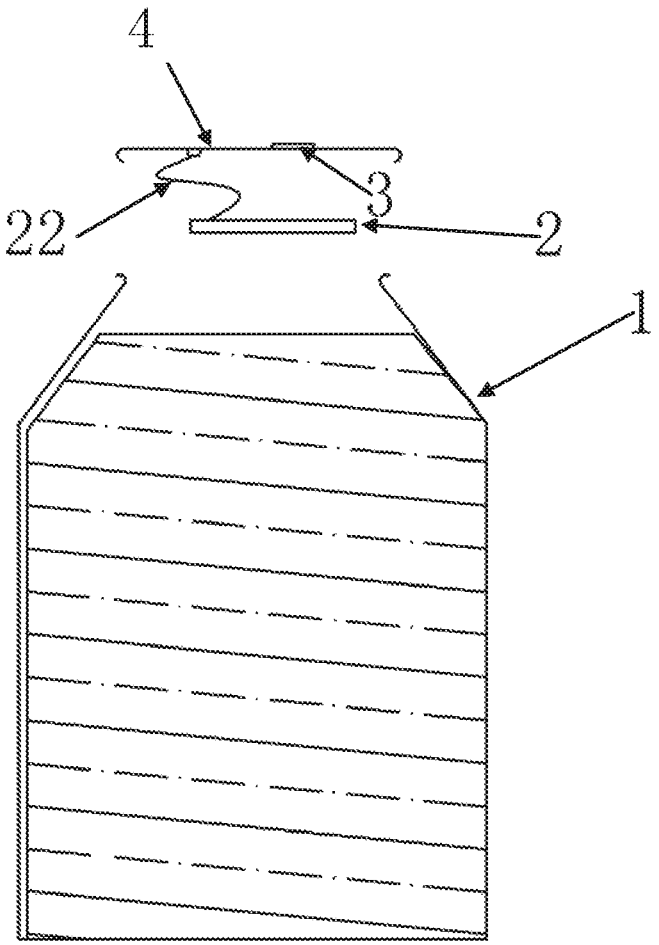
FIG. 1 is a schematic view showing a state of a beverage container before being sealed according to Embodiment 1 of the present invention.

1. container body
2. floating object
21. through hole
22. thread
3. opening
4. top cover

DETAILED DESCRIPTION OF ILLUSTRATED EMBODIMENTS

The methods of carrying out the present invention are described below by way of specific embodiments. And those skilled in the art are able to understand other advantages and functions of the present invention from the disclosure. The embodiments described in the present invention do not represent the whole embodiments of the present invention. On the basis of the embodiments of the present invention, all other embodiments obtained by those skilled in the art without further creative efforts fall within the scope of the present invention.

In the meantime, the terms 'upper', 'lower', 'left', 'right', 'intermediate', and the like, are used in this specification for convenience of description only, and are not intended to limit the scope of the present invention. Changes or adjustments to the relative positions are considered to be within the scope of the present invention without substantial changes.

Embodiment 1

Figure 2:
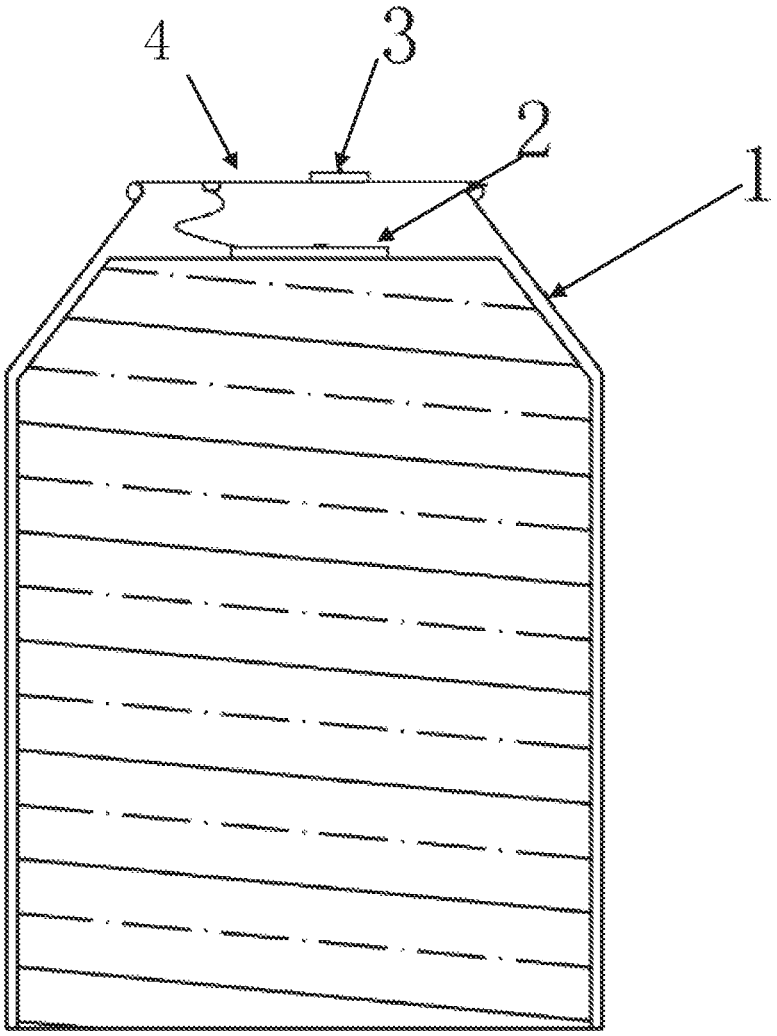
FIG. 2 is a schematic view showing a state of the beverage container after being sealed according to Embodiment 1 of the present invention.
Figure 3:
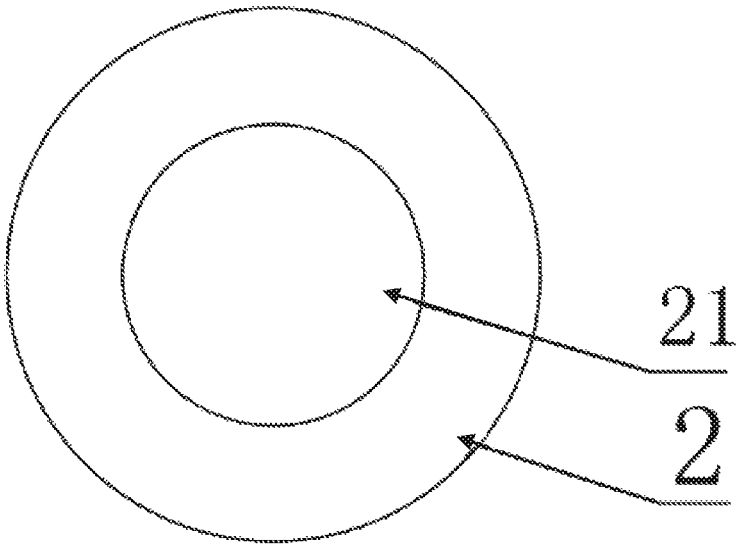
FIG. 3 is a front view showing a floating object of the beverage container according to Embodiment 1 of the present invention.

As shown in FIGS. 1 to 3, the present embodiment provides a beverage container. The beverage container comprises a container body 1 and a floating object 2 for reducing the sloshing amplitude of the beverage. The container body 1 is a metal can or a carton beverage box. The floating object 2 is set in the container body 1 and floats on the surface of the beverage in the container body 1. The floating object 2 is larger than an opening 3 of a top cover 4 of the container body 1. The floating object 2 is provided with at least one through hole 21 for preventing the floating object 2 from blocking the opening 3 of the top cover 4 of the container body 1.

Preferably, the floating object 2 is a round piece.

Preferably, the floating object 2 is connected to an inner wall of a top cover of the container body 1 by a thread 22. One end of the thread 22 is tied to the floating object 2 while the other end of the thread 22 is fixed on the inner wall of the top cover of the container body 1 by food grade coagulable glue.

Preferably, the thread 22 is free to move with the floating object 2 and the beverage.

Preferably, the thread 22 is a sanitary sterilized cotton thread.

After pouring a beverage into the beverage container, the floating object 2 is connected to the inner wall of the top cover of the container body 1 through the thread 22. Then before sealing the beverage container, placing the floating object 2 in the beverage container for it to float on the beverage.

While pulling the pull tab or walking with the beverage container after it is opened, the beverage container shakes to cause the floating object 2 to sway simultaneously. In the meantime, the inertial force generated by the floating object 2 swaying thus collides with the impact generated by the beverage shaking so that a portion of the impact caused from the beverage is counteracted. Since the floating object 2 always floats on the surface of the beverage and is larger than the opening 3 of the container body 1, the floating object 2 forms a barrier to prevent the beverage from spilling. In addition, the floating object 2 is able to change the surface tension of the beverage to prevent the spillage of the beverage.

The above-mentioned embodiments are the preferred embodiments of the present invention. Variations and modifications are allowed within the scope of the invention. Those skilled in the art will appreciate that the features described above can be combined in various ways to form multiple variations of the invention. As a result, such variations fall within the scope of the protection to the present invention.

What is claimed is:

1. A beverage container, comprises a container body (1) and a floating object (2) for reducing the sloshing amplitude of the beverage, the floating object (2) is set in the container body (1) and floats on the surface of the beverage in the container body (1), the floating object (2) is larger than an opening (3) of a top cover (4) of the beverage container, the floating object (2) is provided with at least one through hole (21) for preventing the floating object (2) from blocking the opening (3) of the top cover (4) of the beverage container;

the floating object (2) is connected to an inner wall of the top cover (4) of the container body (1) by a thread;

characterized in that the thread is a sanitary sterilized cotton thread.

2. The beverage container according to claim 1, characterized in that the floating object (2) is a round piece.

3. The beverage container according to claim 1, characterized in that the thread is free to move with the floating object (2) and the beverage.

4. The beverage container according to claim 1, characterized in that the container body (1) is a metal can.

5. The beverage container according to claim 1, characterized in that the container body (1) is a carton beverage box.

* * * * *